US008313005B2

(12) United States Patent
Scarola

(10) Patent No.: US 8,313,005 B2
(45) Date of Patent: Nov. 20, 2012

(54) PLASTIC COFFEE CONTAINER WITH PINCH GRIP

(75) Inventor: Leonard S. Scarola, Basking Ridge, NJ (US)

(73) Assignee: Kraft Foods Global Brands, LLC, Northfield, IL (US)

( * ) Notice: Subject to any disclaimer, the term of this patent is extended or adjusted under 35 U.S.C. 154(b) by 1090 days.

(21) Appl. No.: 11/498,141

(22) Filed: Aug. 3, 2006

(65) Prior Publication Data

US 2008/0029475 A1 Feb. 7, 2008

(51) Int. Cl.
*B65D 25/10* (2006.01)

(52) U.S. Cl. ..... 220/771; 215/384; 215/382; 215/396; 220/752; 220/669

(58) Field of Classification Search ..... 215/384, 215/398, 382, 396; 220/771, 669, 752, 770
See application file for complete search history.

(56) References Cited

U.S. PATENT DOCUMENTS

D198,405 S * 6/1964 Racknagel ..... D9/543
3,185,353 A * 5/1965 Mercier ..... 222/206
D213,040 S 12/1968 Schaper
D284,941 S * 8/1986 Porteous ..... D9/540
4,912,048 A 3/1990 Smith et al.
5,178,290 A 1/1993 Ota
5,199,587 A * 4/1993 Ota et al. ..... 215/381
5,199,588 A 4/1993 Hayashi
5,215,203 A * 6/1993 Malcolm ..... 215/384
D343,794 S * 2/1994 D'Amico et al. ..... D9/530
D370,850 S 6/1996 Beaver
5,598,941 A * 2/1997 Semersky et al. ..... 215/384
D382,807 S * 8/1997 Silvers et al. ..... D9/520
D389,067 S 1/1998 Lown
5,868,272 A * 2/1999 Deal ..... 220/669
D413,200 S 8/1999 Baker
D444,391 S 7/2001 Bansal et al.
D448,674 S 10/2001 Mooney
D448,675 S 10/2001 Thierjung
D452,158 S * 12/2001 Dygert ..... D9/538
6,349,839 B1 * 2/2002 Mooney ..... 215/384
6,375,025 B1 * 4/2002 Mooney ..... 215/384
6,390,316 B1 * 5/2002 Mooney ..... 215/384
6,398,052 B1 6/2002 Cheng
D462,012 S * 8/2002 Manderfield, Jr. ..... D9/530
6,439,413 B1 * 8/2002 Prevot et al. ..... 215/381
D473,142 S * 4/2003 Beaver ..... D9/530

(Continued)

OTHER PUBLICATIONS

Hills Bros. "Original Blend Easy-Grip Handle"—photos, red coffee container with black top.

(Continued)

*Primary Examiner* — Anthony Stashick
*Assistant Examiner* — Christopher McKinley
(74) *Attorney, Agent, or Firm* — Stites & Harbison PLLC; Marvin Petry

(57) ABSTRACT

A plastic container for a particulate product includes a base and a surrounding wall member upstanding therefrom which generally define a container main interior volume. A top connects to the surrounding wall member and includes a large opening sufficient to receive about a 5 inch cylinder therethrough. The surrounding wall member includes a pair of pinch pockets having a lateral opening separation W which is not greater than about 2.5 inches and/or a lateral minimum separation C of not greater than about 2.0. In some embodiment, a thumb receiving cavity is provided above the pinch pockets. The pinch pockets are configured and sized for easy grasping and holding of the container.

47 Claims, 8 Drawing Sheets

U.S. PATENT DOCUMENTS

| | | | | |
|---|---|---|---|---|
| D476,898 | S * | 7/2003 | Schuller et al. | D9/529 |
| D480,312 | S * | 10/2003 | Mungur et al. | D9/537 |
| D480,974 | S * | 10/2003 | Blank | D9/543 |
| 6,640,990 | B2 * | 11/2003 | Saito et al. | 215/384 |
| D483,269 | S * | 12/2003 | Walsh et al. | D9/522 |
| 6,722,514 | B2 * | 4/2004 | Renz | 215/384 |
| D500,679 | S | 1/2005 | Walsh et al. | |
| D520,371 | S * | 5/2006 | Clamage | D9/540 |
| 7,097,061 | B2 * | 8/2006 | Simpson et al. | 215/396 |
| 7,578,412 | B2 * | 8/2009 | Clamage | 220/771 |
| 2002/0195471 | A1 * | 12/2002 | Nottingham et al. | 222/570 |
| 2003/0010787 | A1 * | 1/2003 | Dalton et al. | 220/912 |
| 2004/0137110 | A1 | 7/2004 | Dalton et al. | |
| 2005/0040132 | A1 * | 2/2005 | Saito et al. | 215/384 |
| 2005/0121409 | A1 * | 6/2005 | Penny et al. | 215/384 |
| 2006/0021984 | A1 * | 2/2006 | Nottingham et al. | 220/288 |
| 2007/0045223 | A1 * | 3/2007 | Noll et al. | 215/384 |
| 2007/0187420 | A1 * | 8/2007 | Gruskin et al. | 220/771 |

OTHER PUBLICATIONS

Café Terra "Guatemalan Breakfast Blend"—photographs of a clear container with a white cap.

Folgers® plastic coffee container, approximately 6½ inches in diameter as shown in Figures 1 and 2 and described in paragraphs [0002]-[0005] of this application and as shown in the two attached black and white photographs, on sale more than one year before the filed of this application.

* cited by examiner

FIG. 8
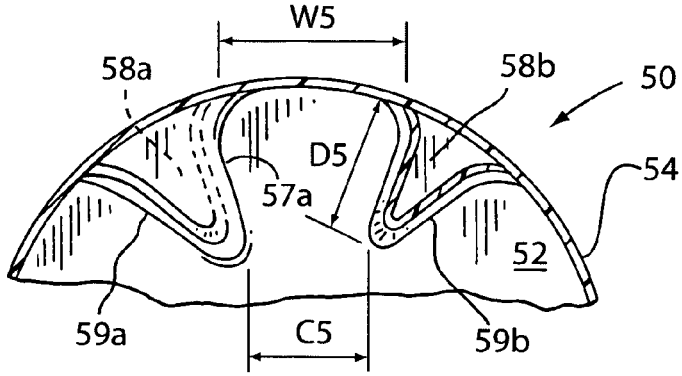
FIG. 9
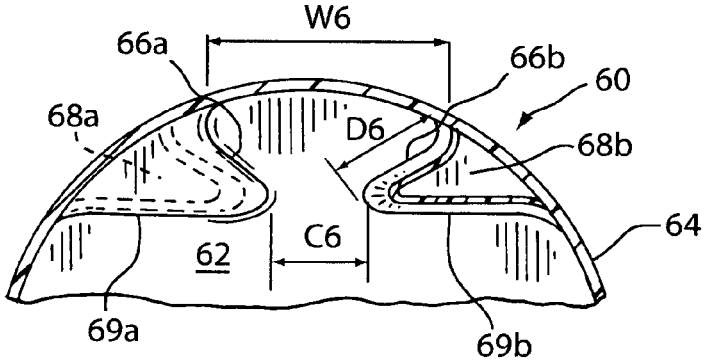
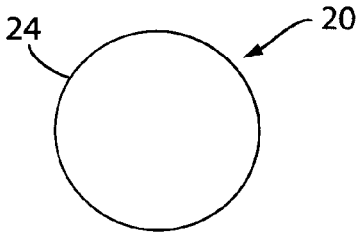
FIG. 10
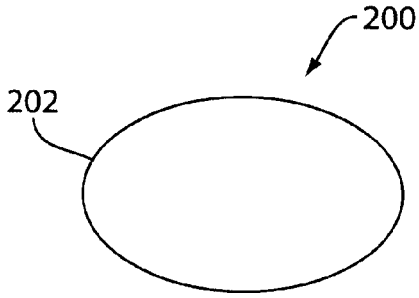
FIG. 11
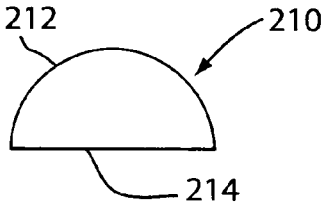
FIG. 12
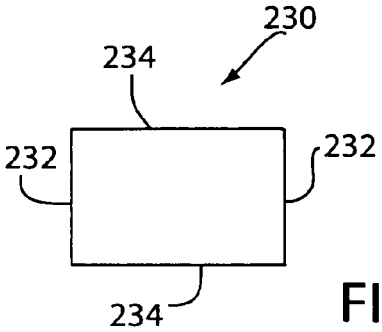
FIG. 14
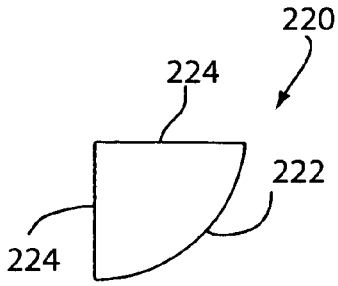
FIG. 13

PLASTIC COFFEE CONTAINER WITH PINCH GRIP

BACKGROUND OF THE INVENTION

Containers for particulate (roast or ground) coffee have many unique requirements not considered for other containers. For example, coffee particulates give off gases while being stored, and are deleteriously affected by air. Thus, coffee particulate containers must prevent the ingress of air and hence be air-tight; but such containers must also be suitably robust to withstand a build-up of pressure, or alternatively, the container must vent the built up gases before the pressure thereof damages (miss-shapes or breaks) the container.

While particulate coffee containers were previously generally made of metal formed into a cylinder with a top and a bottom (which was thus easily made robust and air-tight), new cylindrical and other plastic containers, particularly with layered walls, have now been found to be suitable for containing particulate coffee. However, where such plastic containers have sufficient size to store a desired volume of particulate coffee, typically in the range of 2-4 pounds and having diameters of about 5-7 inches, such containers have been difficult to handle. Thus, ease of use by the user of such plastic containers at home has also been a problem.

Cylindrical plastic coffee containers which are sized as discussed above have been known with pinch handles to provide for easier handling and holding. However, such pinch handles require significant friction to be generated by the thumb/fingers of the user to prevent slippage, which friction is the result of the force with which the thumb/fingers engage the pinch handle. Thus, such pinch handles are difficult for the user to grasp and then to hold with the required force for a sufficient time due to tiring of the thumb/finger muscles, so that the overall container weight which a user is able to hold is limited. In addition, such containers may be hard to hold in view of the moment exerted on the wrist of the user due to the distance to the center of gravity of the container.

For example, depicted schematically in FIGS. 1-2 is a prior art cylindrical plastic coffee container 10 of a size to contain about 2.125 pounds of coffee and having a pinch grip for lifting and holding container 10. It will be appreciated that FIG. 1 is a rear cross sectional elevation view of container 10, while FIG. 2 is a cross sectional plan view taken along section line 2-2 in FIG. 1 of a relevant portion of container 10. Generally, container 10 is cylindrical and formed from a base 12 and a surrounding generally cylindrical wall member 14 upstanding from base 12. The transition intersection of base 12 and surrounding wall member 14 is curved for strength and ease of formation. As shown, container 10 has a wide/large opening in a top 15, on which top 15 a removable lid (not shown) is retained after opening of a foil seal (not shown) adhered to top 15 during shipping, as is well known in the art. This prior art container 10 has an outside diameter of about 6.25 inches and a height of about 6.25 inches as well.

The pinch grip for cylindrical container 10 is made of two mirror image concave pinch pockets 18*a* and 18*b* formed integrally in generally cylindrical wall member 14 of container 10. It will be appreciated that pinch pockets 18*a* and 18*b* are viewed from above in FIG. 2, as indicated by section line 2-2 in FIG. 1. Each pinch pocket 18 extends generally vertically along surrounding wall member 14 with a height of about 4 inches. Each pinch pocket 18 also has a curved intersection of each inside wall 16*a* and 16*b* of respective pinch pockets 18*a* and 18*b* (i.e., "inside" relative to the opposed thumb and fingers of the hand used to grip container 10) with surrounding wall member 14, so that inside walls 16*a* and 16*b* are slightly C shaped along the height as shown best in FIG. 1. Each pinch pocket 18 also extends somewhat deeper into container 10 from surrounding wall member 14 at about a vertical center thereof by a distance B, which distance B is about 0.375 inches. It will noted that the distance B depicted in FIG. 2 is the distance from the top corner of pinch pocket 18*a* to the outermost portion of the C shape thereof as seen from above, consistent with the C shape as noted above at surrounding wall member 14 of inside walls 16*a* and 16*b*. This produces an overall maximum depth D1 into container 10 of about 0.75 inches. At the vertical center of each pinch pocket 18, there is a lateral minimum separation C1 of pockets 18 from each other (on the inside of container 10) of about 2.375 inches, and a lateral opening separation W1 of pockets 18 from each other where pockets 18 intersect with surrounding wall member 14 of about 3.0 inches. Typically, container 10 is blow-molded from an HDPE plastics material.

BRIEF SUMMARY OF THE INVENTION

In accordance with a first embodiment of the present invention, a plastic container for a particulate product includes a base and a surrounding wall member which is upstanding from the base, with the base and the surrounding wall member generally defining a container main interior volume. A top connects with the surrounding wall member and includes a large opening therein which is preferably at least sufficient for a 5 inch diameter cylinder to fit therethrough. The surrounding wall member includes a pair of pinch pockets having a lateral opening separation W which is not greater than about 2.5 inches.

In the first embodiment, the lateral opening separation W is preferably between about 2.0 to 2.5 inches, and W is most preferably about 2.25 inches with each pinch pocket also then having a vertical height of at least about 2.5 inches. In addition, the pinch pockets are centrally directed; and each pinch pocket has a depth D of not less than about 1.25 inch, and preferably the depth D is in the range of about 1.25-2.25 inches and is most preferably about 1.75 inch.

Also in the first embodiment, the pair of pinch pockets have a lateral minimum separation C of about 1.0 to 1.5 inches, and preferably about 1.25 inches. In addition, each pinch pocket has a vertical length of at least about 2.5 inches, and the lateral opening separation W is about 2.25 inches.

Other features of the first embodiment, which can be used singly or in combination as appropriate and desired, are: (a) the surrounding wall member further includes a thumb receiving concavity above each pinch pocket; (b) a portion of the surrounding wall member including the pinch pockets is generally curved in cross section; (c) a portion of the surrounding wall member including the pinch pockets is generally straight in cross section; (d) a portion of the surrounding wall member including the pinch pockets is a corner; (e) a portion of the surrounding wall member including the pinch pockets is a peaked side; (f) a portion of the surrounding wall member including the pinch pockets is recessed radially inward relative to a remainder of the surrounding wall member; (g) a portion of the surrounding wall member between the pinch pockets is recessed radially inward relative to a remainder of the surrounding wall member; and/or (h) a substantially horizontal support surface is provided between the pinch pockets.

In a second embodiment of the invention, the container similarly comprises a base, a surrounding wall member and a top with a large opening at least sufficient for a 5 inch diameter cylinder to fit therethrough. In addition, the surrounding wall member has a pair of pinch pockets having a lateral minimum separation C of not greater than about 2.0 inches. Preferably, the lateral minimum separation C is about 1.0 to 1.5 inches. More preferably, each pinch pocket has a vertical height of at least about 2.5 inches, and the lateral minimum separation C is about 1.25 inches.

In the preferred second embodiment, the pinch pockets have outside walls that are generally collinear to one another, and each pinch pocket has a depth D of not less than about 1.0 inch. Preferably, the depth D is between about 1.25-1.75 inches, and most preferably the depth D is about 1.5 inches. The other features of the first embodiment noted above are also usable as appropriate with this embodiment as well.

In another embodiment, a plastic container having a base, a surrounding wall member and a top with a large opening further includes a pair of pinch pockets and a separate thumb receiving concavity above each pinch pocket. The configurations of the pinch pockets can be as described above in either of the two noted embodiments. In addition, in one preferred embodiment, each thumb receiving cavity extends inwardly of the surrounding wall member a distance that is greater than a distance D that an adjacent the pinch pocket extends inwardly. The other features of the first embodiment noted above are also usable as appropriate with this embodiment as well.

In a further embodiment, a plastic container having a base, a surrounding wall member and a top with a large opening further includes a handle. The handle includes a pair of pinch pockets formed in a portion of the surrounding wall member, with the pinch pockets having a depth, shape and distance from each other so as to substantially minimize a distance between a wrist of a user when holding the container by the pinch pockets and a center of gravity of the container. Various shapes and features of the pinch pockets or handle are usable as appropriate and as described above for the other embodiments.

It is an advantage of the present invention that a plastic container from which a particulate product is withdrawn includes a pinch grip which is easily grasped and held.

It is also an advantage of the present invention that the pinch grip includes a thumb receiving cavity located above pinch pockets, making the container easier to grip and hold. It is also an advantage of the present invention that the pinch pockets are recessed into the surrounding wall member of the container to provide additional upper and/or lower support surfaces.

It is a further advantage that the container critical dimensions are disclosed which provide the pinch grip with the best combination of elements to provide a pinch grip which is easier to handle and hold.

Other features and advantages of the present invention are stated in or apparent from detailed descriptions of presently preferred embodiments of the invention as discussed in greater detail below.

BRIEF DESCRIPTION OF THE SEVERAL VIEWS OF THE DRAWINGS

FIG. 8 is a schematic cross sectional plan view of a coffee container similar to the first embodiment of FIG. 4 but having a thumb receiving cavity.

FIG. 9 is a schematic cross sectional plan view of a coffee container similar to the second embodiment of FIG. 5 but having a thumb receiving cavity.

FIG. 10 is a schematic plan view of the cylindrical coffee container depicted in FIG. 3.

FIG. 11 is a schematic plan view of an elliptically shaped coffee container in accordance with another embodiment of the present invention.

FIG. 12 is a schematic plan view of a semi-circular shaped coffee container in accordance with another embodiment of the present invention.

FIG. 13 is a schematic plan view of a sector shaped coffee container in accordance with another embodiment of the present invention.

FIG. 14 is a schematic plan view of a rectangular shaped coffee container in accordance with another embodiment of the present invention.

DETAILED DESCRIPTION OF THE INVENTION

Figure 3:
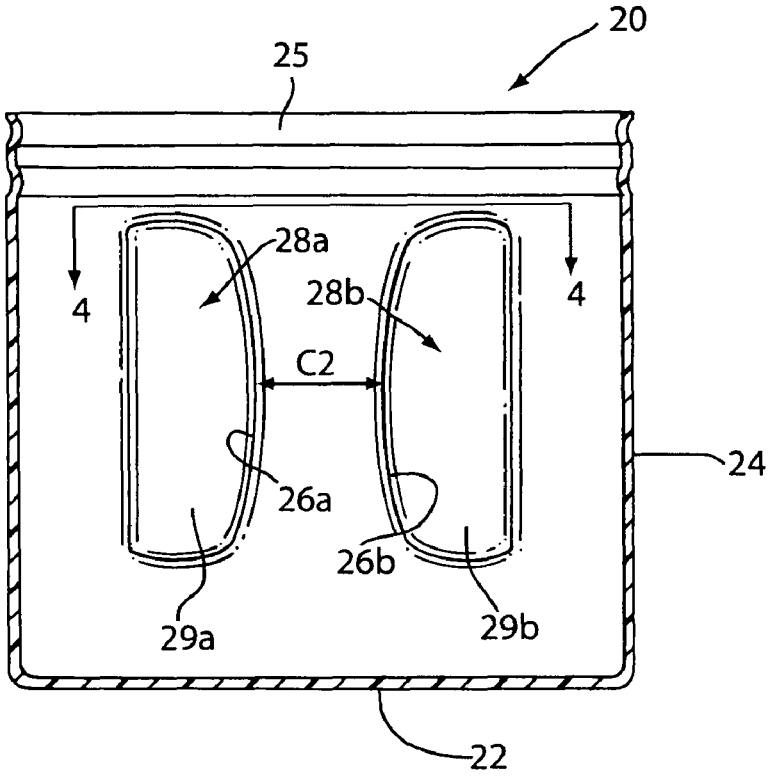
FIG. 3 is a schematic cross sectional rear elevation view of a cylindrical coffee container showing a first embodiment of the present invention.
Figure 4:
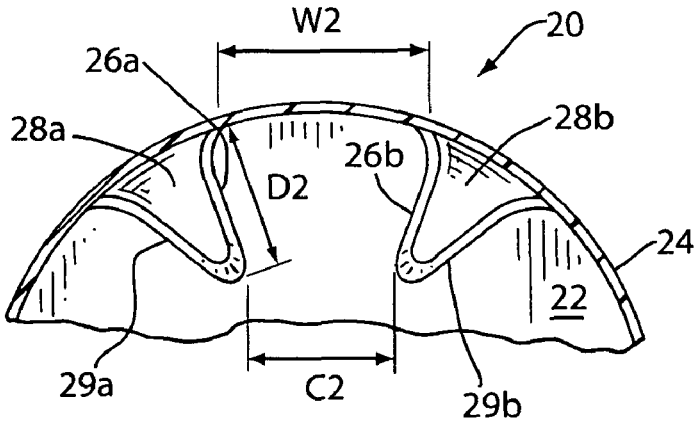
FIG. 4 is a schematic cross sectional plan view of the coffee container depicted in FIG. 3 taken along section line 4-4.

With reference now to the drawings in which like numerals represent like elements in the views, a plastic particulate coffee container 20 according to a first embodiment of the present invention is shown in FIGS. 3-4. It will be appreciated that container 20 is depicted as being cylindrical in cross section as shown in FIG. 10, and thus is similar in that regard to prior art container 10. However, container 20 could also be of different cross sectional shapes as discussed hereinafter and as disclosed in Ser. Nos. 11/353,091, 11/353,092, and 11/353,093 filed Feb. 14, 2006 by GRUSKIN et al. (and assigned to the same assignee) which are hereby incorporated by reference; and container 20 is also preferably similar (except for the use of a pinch grip instead of a pass through handle) to any one of the containers described those serial numbers.

Like the containers described in those serial numbers, (or like prior art container 10), container 20 is designed for the containing of ground or roast (particulate) coffee or a like non liquid-like product, so that container 20 is made of a suitable blow-molded plastic such as high density polyethylene (HDPE), preferably by an extrusion blow molding rotary process or the like. As so formed, container 20 includes a generally round base 22 with an integrally formed surrounding wall member 24 extending upwardly therefrom. In order to allow easy withdrawal of coffee from within container 20, it will be appreciated that container 20 has a large top opening 25, such as substantially the same diameter as surrounding wall member 24, and which top opening is at least sufficient for a 5 inch cylinder to fit therethrough.

As noted above, one problem with prior art containers such as container 10 is that they can be hard to handle and hold. It will thus be appreciated that container 20 includes a pinch grip formed from two pinch pockets 28*a* and 28*b* which is designed to make container 20 easier to handle and hold. It will also be appreciated that pinch pockets 28*a* and 28*b* are shown as viewed from above in FIG. 4 as indicated by section line 4-4 in FIG. 3 in the same manner that pinch pockets 18*a* and 18*b* mentioned above are viewed. Pockets 28 are generally designed for a container having a diameter of between about 5-7 inches (and hence an opening sufficient to fit about a 5 inch cylinder therethrough), and particularly for a container having about a 6.0 inch diameter. The height of pockets 28 is at least about 2.5 inches, and preferably is between about 3.5-4.5 inches, and is preferably about 4.0 inches. Pinch pockets 28 are shown as vertically located centrally to the height of container 20, but it will be appreciated that pinch pockets could be offset vertically from the mid-height either higher or lower (and an advantage of a lower offset is discussed below with respect to container 120 depicted in FIGS. 20-21).

While otherwise broadly similar to pinch pockets 18 of the prior art, it will be noted that whereas prior art container 10 had a lateral opening separation distance W1 of 3.0 inches, container 20 of the present embodiment has a lateral opening separation W2 which is not greater than 2.5 inches, and preferably is between about 2.0-2.5 inches, and most preferably is about 2.25 inches. In addition to this reduced lateral opening separation, a reduced lateral minimum separation C2 of pinch pockets 28 is also desired, which is significantly less than the 2.375 inches lateral minimum separation C1 of prior art container 10. In particular, lateral minimum separation C2 is less than 2.0 inches, and preferably is between about 1.0-1-5 inches, and most preferably about 1.25 inches.

Figure 1:
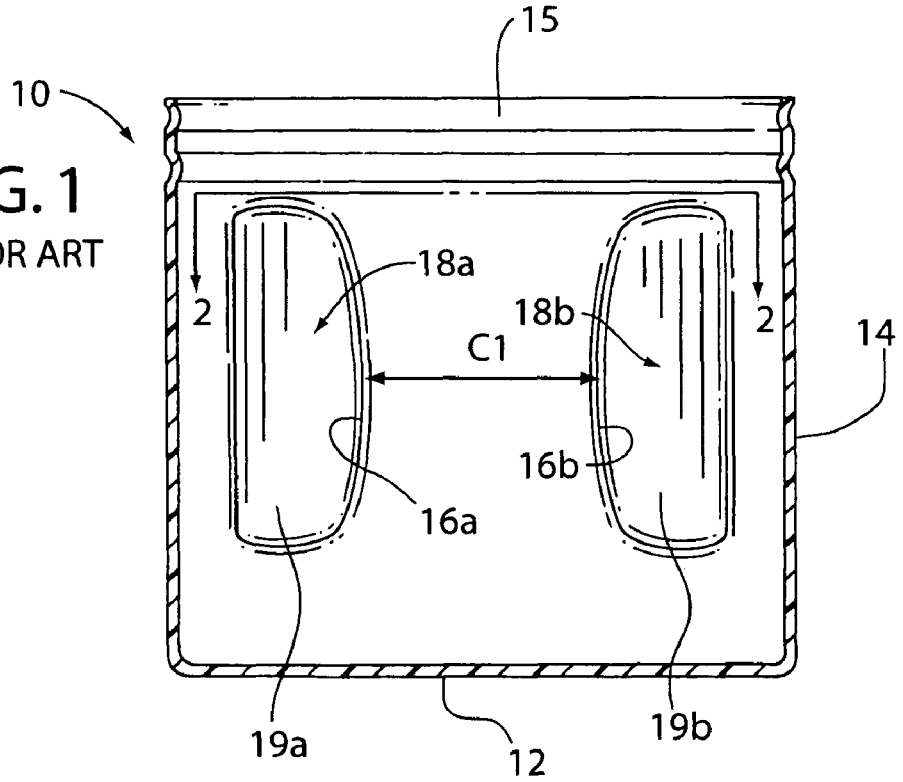
FIG. 1 PRIOR ART
FIG. 1 is a schematic cross sectional rear elevation view of a cylindrical coffee container of the prior art.
Figure 2:
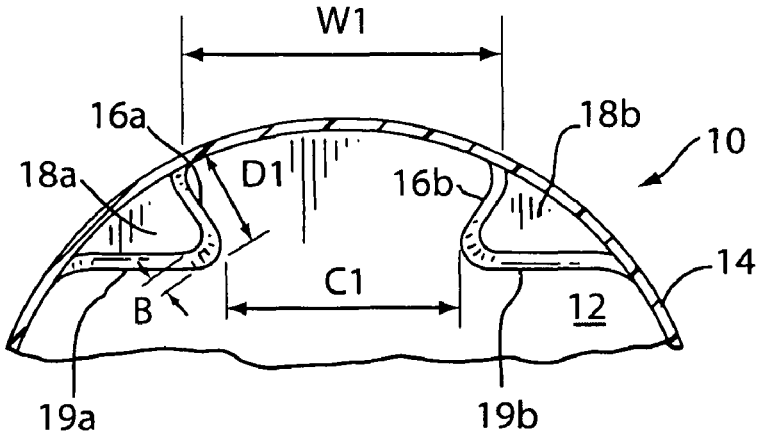
FIG. 2 PRIOR ART
FIG. 2 is a schematic cross sectional plan view of a portion of the prior art cylindrical coffee container depicted in FIG. 1 taken along section line 2-2.

Like prior art pinch pockets 18, pinch pockets 28 also extend somewhat deeper into container 10 from surrounding wall member 24 at about a vertical center thereof relative to the top and bottom by a distance essentially the same as distance B discussed above for the prior art container 10 (or about 0.375 inches as noted above). However, pinch pockets 28 have a depth D2 which is not less than 1.25 inches, and which is preferably in the range of about 1.25-2.25, and preferably is about is 1.75. Further, it will be noted that pinch pockets 28 are generally radially directed, and in particular pinch pockets have inside walls 26*a* and 26*b* as well as outside walls 29*a* and 29*b* that are generally radially directed. This radial direction is different from prior art pinch pockets 18. In particular, while prior art pinch pockets 18 has inside walls 16 which are radially directed, outside walls 19 are generally collinear to one another and hence not radially directed. Thus, overall, prior art pinch pockets 18 are not radially directed (see FIG. 2).

This radial direction of pockets 28, together with the smaller lateral opening separation W2, smaller lateral minimum separation C2, and deeper depth D2, make it easier to insert the fingers and thumb into pinch pockets 28 to grasp container 20 and to hold the fingers and thumb more naturally in place against inside walls 26*a* and 26*b*. This reduces finger muscle strain, making the handling and holding of container 20 much easier relative to prior art container 10. In addition, the deeper penetration of the fingers and thumb also means that there is now provided some vertical support (or some more relative to prior art container 10) as the upper portions of the ends of the user's forefinger and thumb engage the tops of pinch pockets 28 as appreciated from FIG. 3. Such vertical support also reduces the strength of the pinch effort needed by the fingers and thumb to hold and handle container 20 relative to that provided by prior art container 10, which thus also serves to reduce finger muscle strain.

The deeper penetration of the fingers further means that the distance from the center of gravity for container 20 to the center of the wrist joint of the user is also reduced relative to that of container 10. Thus, the resultant moment on the wrist joint is also reduced, again helping the user to more easily hold and handle container 10 (especially when container 20 is filled). In addition, the deeper penetration also allows a portion of the palm of the user to more easily contact the portion of surrounding wall member 24 between pinch pockets 28, so that resisting the pivoting moment of container 20 (and also the vertical supporting of container 20) is additionally made easier as the area of the hand resisting movement is spread over a larger area.

It will also be appreciated that with this reduced lateral opening separation W2 and reduced lateral minimum separation C2, the fingers and opposed thumb of the user when engaged in pinch pockets 28 are consequently closer together (approximately the distance C2) than in the prior art container 10. This is a more natural separation distance for both separations W2 and C2, and permits the fingers and thumb to engage inside walls 26*a* and 26*b* of each pinch pocket 28 to a greater extent than inside walls 16*a* and 16*b* of prior art pinch pockets 18 are engaged and with less muscle strain. This more positive engagement of inside walls 26*a* and 26*b* is also facilitated by the increased depth D2 which together with decreased lateral minimum separation C2 also provides a much greater surface area to be engaged by the thumb and fingers, as well as by the general radial directions of pinch pockets 28.

The ability of the above discussed particular features of container 20 to allow for a more easy holding and handling of container 20 can be suitably envisioned by imagining the difference between a half circle shape of the fingers and thumb of a hand engaging pinch pockets 18, and a greater than half circle shape of the same fingers and thumb of a hand engaging pinch pockets 28. Thus, more of the fingers and thumb of the hand are able to be located in the concavities of pinch pockets 28 and against inside walls 26*a* and 26*b*- relative to pinch pockets 18 where the narrow intersection (i.e., bridging connection) of pinch pockets 18 with surrounding wall member 14 are more likely to be engaged (and engaged with less effectiveness). In addition, the decreased lateral minimum separation C2 and greater depth D2 also translate into a longer and hence greater surface/friction area to be contacted by the thumb and fingers along inside walls 26*a* and 26*b* in pinch pockets 28, particularly where these pockets 28 are radially directed similar to the arced shape of the fingers and thumb; which thus also increases the ease of holding and handling. The decreased lateral minimum separation C2 and greater depth D2 further translate into a reduced distance from the center of support for container 10 by the fingers and thumb to the center of gravity of container 10.

Figure 5:
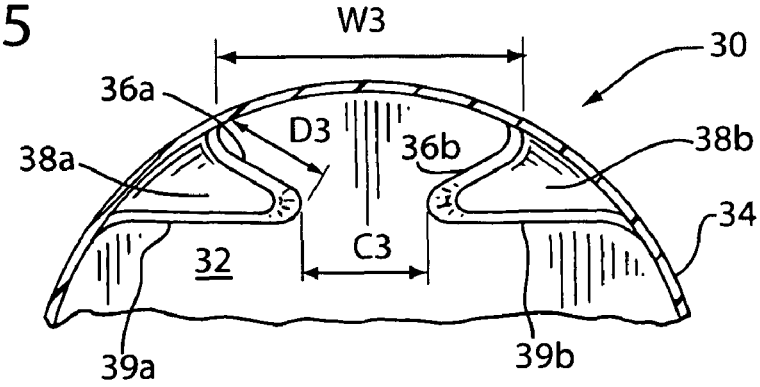
FIG. 5 is a schematic cross sectional plan view of a coffee container similar to the view of FIG. 4 but showing a second embodiment of the present invention.

Depicted in FIG. 5 is a second embodiment of a plastic particulate coffee container 30 according to the present invention. It will be appreciated that container 30 can otherwise be similar to container 20, so that only that portion of container 30 corresponding to the same portion shown in FIG. 4 is depicted. Like container 20, container 30 includes a generally round base 32 with a surrounding wall member 34 extending upwardly therefrom. And like container 20, container 30 is designed to be easier to handle and hold than prior art container 10.

Container 30 includes a particular pinch grip formed from two pinch pockets 38*a* and 38*b* which are designed to make container 30 easier to handle and hold. Like pinch pockets 28, pinch pockets 38 are generally designed for a container having a diameter of between about 5-7 inches (and hence an opening sufficient to fit about a 5 inch cylinder therethrough), and particularly for a container having about a 6.25 inch diameter like prior art container 10. However, it will be noted that whereas container 10 had a lateral minimum separation C1 of 2.375 inches, container 30 of the present invention has a lateral minimum separation C3 which is less than about 2.0 inches and preferably between about 1.0-1.5 inches, and most preferably is about 1.25 inches. And also unlike container 20, container 30 includes a lateral opening separation W3 of about 3.0 inches which is about the same as that of prior art container 10. Further, container 30 has a depth D3 which greater than 1.0 inches, preferably in the range of about 1.25-1.75, and preferably is about is 1.5. It will also be noted that pinch pockets 38 are generally not radially directed like pinch pockets 28 discussed above. Instead, pinch pockets 38 have outside walls 39*a* and 39*b* that are generally collinear and hence similar in that respect to outside walls 19*a* and 19*b* of container 10.

With this smaller lateral minimum separation C3 (i.e., with the fingertips and thumb tip closer) and hence deeper depth D3, or in other words a deeper (into container 30) concavity forming pinch pockets 38*a* and 38*b* relative to pinch pockets 18 of prior art container 10, the thumb and fingers of a user are able bend more when inserted and hence to penetrate deeper into pinch pockets 38*a* and 38*b* to more fully engage inside walls 36*a* and 36*b* of pinch pockets 38*a* and 38*b* even though the lateral opening separation W3 is still as large as that of prior art container 10. In addition, the deeper penetration also allows for some significant vertical support to be achieved as the ends of the forefinger and thumb contact the top of pinch pockets 38 in the same manner as discussed above for container 20. Thus the user is able to more effective handle and hold container 30 relative to prior art container 10 in much the same manners as described above for container 20, so that there is reduced finger muscle strain, etc. for the user compared to that which occurs with container 10.

Figure 6:
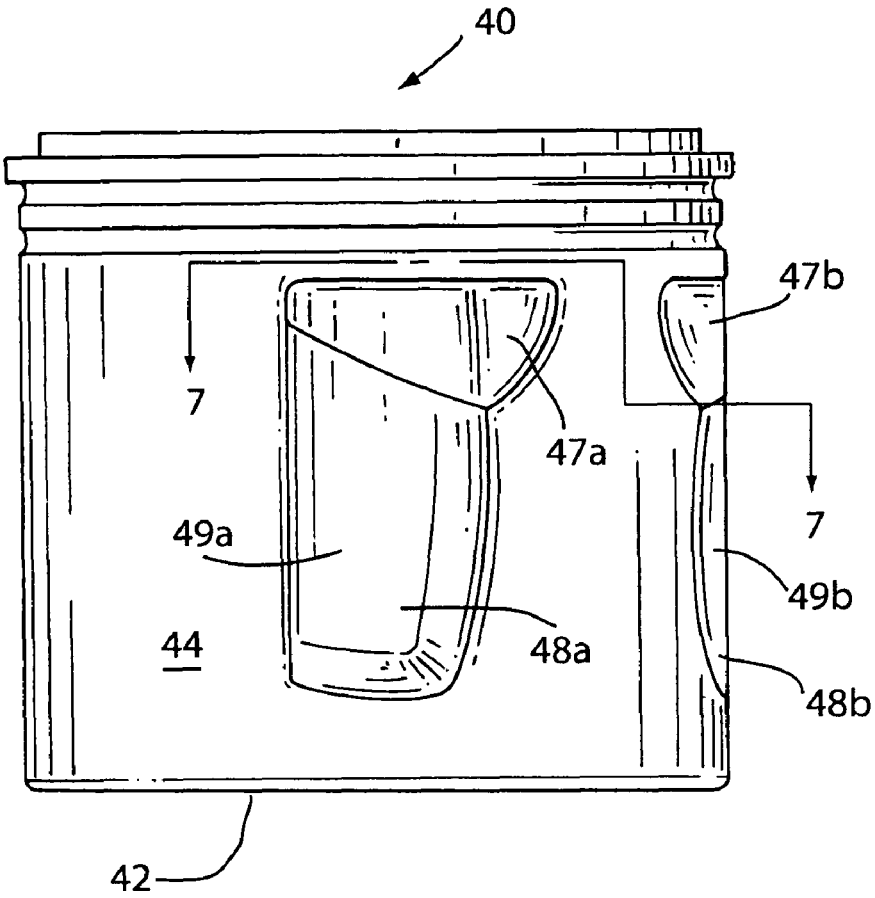
FIG. 6 is a schematic rear and left side elevation view of a coffee container, similar to that of FIG. 3, showing a third embodiment of the present invention having a thumb receiving cavity.
Figure 7:
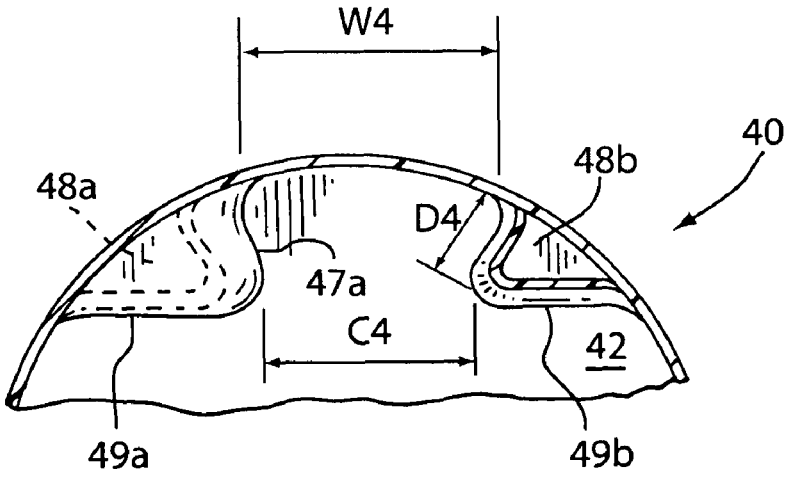
FIG. 7 is a schematic cross sectional plan view of a portion of the coffee container depicted in FIG. 6 taken along section line 7-7.

Depicted in FIGS. 6-7 is a third embodiment of a plastic particulate coffee container 40 according to the present invention. It will be appreciated that container 40 can otherwise be similar to containers 20 or 30. Thus, FIG. 6 is similar to the view shown in FIG. 3, though FIG. 6 is rotated somewhat about a vertical axis and is not a cross section so that the full concavity of pinch pocket 48*a* is viewable. Likewise, FIG. 7 is similar to the views shown in FIGS. 4 and 5. However, as evident from the section line 7-7 shown in FIG. 6, it will also be appreciated that FIG. 7 shows a section above pinch pocket 48*a* and then through pinch pocket 48*b* so the section line 7-7 shows portions of container 40 at different heights. Like containers 20 and 30, container 40 includes a generally round base 42 with a surrounding wall member 44 extending upwardly therefrom. And like containers 20 or 30, container 40 is designed to be easier to handle and hold than container 10.

Container 40 includes a pinch grip formed from two pinch pockets 48*a* and 48*b* which are otherwise broadly similar to the prior art pinch pockets 18*a* and 18*b*. However, near the top of each pinch pocket 48*a* and 48*b*, there are provided respective thumb receiving cavities 47*a* and 47*b*. Thumb receiving cavities 47 extend deeper into container 40 than pinch pockets 48, and the deepest part thereof is shifted closer to the other pinch pocket compared to the deepest part of the concavity of each pinch pocket 48 as shown best in FIG. 6. In addition, the overall concavity forming each thumb receiving cavity 47 is also extended circumferentially closer to the other to reduce the effective (with the thumb located in one thumb receiving cavity 47 and the fingers in the other pinch pocket 48) lateral opening separation W4 to be between about 2.25-2.75 inches, and preferably about 2.5 inches (and hence slightly less than W1=3.0 for prior art container 10). In addition, the effective lateral minimum separation C4 is less than about 2.125 inches and preferably is about 2.0 inches; and the depth D4 of pinch pockets 48 is about 0.75 inches, the same as that of prior art container 10. Similar to outside sidewalls 19 of container 10, outside walls 49*a* and 49*b* are also approximately collinear to one another.

With the above-described construction, container 40 is easier to handle and hold by a user. In particular, when a user grips container 40 with one (either) hand, the thumb is located in one thumb receiving cavity 47 while the fingers are located in the other pinch pocket 48; although depending on desires or hand size of the user, the forefinger can either be located in the other/opposite thumb receiving cavity 47 or together with all of the fingers in the other/opposite pinch pocket 48. Obviously, container 40 can be gripped by either the left or right hand as the user desires since there is a thumb receiving cavity for both the left and right thumbs, and pinch pockets 48 on the opposite side therefrom then receive the fingers.

Due to the presence of deep thumb receiving cavity 47, a more positive vertical support is achieved by the end of the thumb engaging the top of thumb receiving cavity 47 as shown by FIG. 6; and where the forefinger is also located in the opposite thumb receiving cavity 47, some additional vertical support is further provided relative to that which would be provided with the forefinger only in pinch pocket 48 (due to the deeper depth of thumb receiving cavity 47). In addition, due to the reduced (relative to prior art container 10) effective lateral opening separation W4, container 40 is easier to grip and hold in the same manner as described above for container 20 since the critical lateral opening separation for holding is that between the thumb and forefinger (where the majority of the gripping force is effected). Likewise due to the reduced effective lateral minimum separation C4 as compared to lateral minimum separation C1 due to the greater depth of thumb receiving cavity 57, container 40 is also easier to grip and hold in the same manner as described above for container 30 (and 20), so that there is reduced finger muscle strain, etc. for the user compared to that which occurs with container 10.

Depicted in FIG. 8 is a fourth embodiment of a plastic particulate coffee container 50 according to the present invention. It will be appreciated that container 50 can otherwise be similar to containers 20, 30 or 40 as discussed above, so that only that portion of container 50 corresponding to the same portion shown in FIG. 7 is depicted. Like the other containers, container 50 includes a generally round base 52 with a surrounding wall member 54 extending upwardly therefrom. And like containers 20, 30 and 40, container 50 is designed to be easier to handle and hold than container 10 for the same reasons as noted above.

Container 50 includes a pinch grip formed from two pinch pockets 58*a* and 58*b* which are otherwise broadly similar to pinch pockets 28*a* and 28*b* of container 20. However, near the top of each pinch pocket 58*a* and 58*b*, there are provided respective thumb receiving cavities 57 (only the left side one is shown, the right side one not shown being a mirror image thereof). Similar to container 40 discussed above, thumb receiving cavities 57 of container 50 extend deeper into container 50 than pinch pockets 58, and the deepest part thereof is shifted closer to the other pinch pocket compared to the deepest part of the concavity of each pinch pocket 58 as shown. In addition, the overall concavity forming each thumb receiving cavity 57 is also extended circumferentially closer to the other to reduce the effective (with the thumb located in one thumb receiving cavity 57 and the fingers in the other pinch pocket 58) lateral opening separation W5 to be between about 1.5-2.0 inches, and preferably about 1.75 inches. It will thus be appreciated that W5 is significantly less than W1=3.0 for prior art container 10, and is smaller even than W2 (preferably about 2.25) of container 20 and W4 of container 40 due to thumb receiving cavity 57. In addition, the effective lateral minimum separation C5 is between about 1.0-1.5 inches, and preferably is about 1.125 inches; and the depth D5 of pinch pockets 58 is about the same as D2 of container 20 (greater than 1.25 inches, preferably in the range of about 1.25-2.25, and preferably is about is 1.75). It will thus be appreciated that C5 is significantly less than C1=2.375 for prior art container 10, and slightly smaller even than C2 (preferably about 1.25) of container 20 and smaller than C4 of container 40. Similar to container 20, outside walls 59*a* and 59*b* are also approximately radially directed.

With the above-described construction, container 50 is easier to handle and hold by a user. In particular, when a user grips container 50 with one (either) hand, the thumb is located in one thumb receiving cavity 57 while the fingers are located in the other pinch pocket 58 with or without the forefinger located in the other thumb receiving concavity as with container 40. Due to the reduced (relative to prior art container 10) effective lateral opening separation W5 which is even somewhat smaller than for container 20 described above due to thumb receiving cavity 57, container 50 is easier to grip and hold in the same manner as described above for containers 20 and/or 40 since the critical lateral opening separation for holding is that between the thumb and forefinger (where the majority of the gripping force is effected). Likewise, due to the reduced (relative to prior art container 10) effective minimum opening separation C5 which is even slightly smaller than for container 30 described above due to the greater depth of thumb receiving cavity 57, container 50 is easier to grip and hold in the same manner as described above for containers 20 and/or 40 since the thumb and fingers of a user are able bend more when inserted and hence to penetrate deeper into the deeper pinch pockets 58*a* and 58*b* to more fully engage inside walls 56*a* and 56*b* of pinch pockets 58*a* and 58*b*. Container 50 also has the other general advantages discussed above for containers 20 and 40 over prior art container 10.

Depicted in FIG. 9 is a fifth embodiment of a plastic particulate coffee container 60 according to the present invention. It will be appreciated that container 60 can otherwise be similar to containers 20, 30, 40 or 50, as discussed above, so that only that portion of container 60 corresponding to the same portion shown in FIG. 7 is depicted. Like the other containers, container 60 includes a generally round base 62 with a surrounding wall member 64 extending upwardly therefrom and is designed to be easier to handle and hold than container 10.

Container 60 includes a pinch grip formed from two pinch pockets 68*a* and 68*b* which are otherwise broadly similar to pinch pockets 38*a* and 38*b* of container 30. However, near the top of each pinch pocket 68*a* and 68*b*, there are provided respective thumb receiving cavities 67 (only the left side one is shown, the right side one not shown being a mirror image thereof). Similar to container 40 discussed above, thumb receiving cavities 67 of container 60 extend deeper into container 60 than pinch pockets 68, and the deepest part thereof is shifted closer to the other pinch pocket compared to the deepest part of the concavity of each pinch pocket 68 as shown. In addition, the overall concavity forming each thumb receiving cavity 67 is also extended circumferentially closer to the other to reduce the effective (with the thumb located in one thumb receiving cavity 67 and the fingers in the other pinch pocket 68) lateral opening separation W6 to be between about 2.25-2.75 inches, and preferably about 2.5 inches. It will thus be appreciated that W6 is less than W1=3.0 for prior art container 10, and about the same as W4 of container 40. In addition, the effective lateral minimum separation C6 is between about 1.0-1.5 inches, and preferably is about 1.125 inches; and the depth D6 of pinch pockets 58 is about the same as D3 of container 30 (greater than 1.25 inches, preferably in the range of about 1.25-2.25, and preferably is about is 1.75). It will thus be appreciated that C6 is significantly less than C1=2.375 for prior art container 10, and slightly smaller even than C3 (preferably about 1.25) of container 30 and smaller than C4 of container 40. Similar to container 30, outside walls 69*a* and 69*b* are also generally collinear.

With the above-described construction, container 60 is easier to handle and hold by a user. In particular, when a user grips container 60 with one (either) hand, the thumb is located in one thumb receiving cavity 67 while the fingers are located in the other pinch pocket 68 with or without the forefinger located in the other thumb receiving concavity as with container 40. Due to the reduced (relative to prior art container 10 or container 30) effective lateral opening separation W6, container 60 is easier to grip and hold in the same manner as described above for containers 30 and/or 40 since the critical lateral opening separation for holding is that between the thumb and forefinger. Likewise, due to the reduced (relative to prior art container 10) effective minimum opening separation C6 which is even slightly smaller than for container 30 described above and due to the greater depth of thumb receiving cavity 67, container 60 is easier to grip and hold in the same manner as described above for containers 30 and/or 40 since the thumb and fingers of a user are able bend more when inserted and hence to penetrate deeper into pinch pockets 68*a* and 68*b* to more fully engage inside walls 66*a* and 66*b* of pinch pockets 68*a* and 68*b*. Container 60 also has the other general advantages discussed above for containers 30 and 40 over prior art container 10.

As noted above, containers 20, 30, 40, 50 and 60 were generally depicted as being cylindrical in cross section as shown in FIG. 10 for container 20, and thus with a pinch grip provided in an arcuate section of each container. However, it will be appreciated that the container need not be cylindrical, and could instead have a portion which is arcuate or otherwise similarly curved and in which curved portion a pinch grip according to the present invention could be provided. Thus, depicted in FIG. 11 is a container 200 which is elliptical in cross section. It will be appreciated that a suitable pinch grip according to the present invention, such as any of those described above for containers 20, 30, 40, 50 and 60, could be provided in curved surrounding wall member 202 thereof at (preferably) the location of an intersection with the major axis or minor axis of the ellipse, or at any location therebetween, as desired.

Besides an elliptically shaped surrounding wall member, the container having a pinch grip in accordance with the present invention could also have an arcuate or curved portion of the surrounding wall member, with some or all of the remaining surrounding wall member having one or more straight or curved sides. For example, depicted in FIG. 12 is a container 210 having a surrounding wall member comprised of a semi-circular wall portion 212 and a straight wall portion 214. Thus, a pinch grip could be provided in semi-circular wall portion 212 in accordance with any of the above described embodiments. In addition, semi-circular wall portion 212 could be more or less than semi-circular, and could be otherwise curved (elliptical, or other smooth connection of non-linear points) as desired.

As another example, depicted in FIG. 13 is a container 220 having a surrounding wall member comprised of a quarter-circular wall portion 222 and two straight side wall portions 224. Obviously, quarter-circular wall portion 222 could be of greater or lesser extent (i.e., the angle between straight side wall portions 224 could be other than 900 as shown), and otherwise curved. In addition, while FIGS. 12 and 13 show containers 210 and 220 respectively with one and two straight wall portions, any number of straight wall portions could be provided so that any polygonal shape with a curved wall portion and pinch grip in accordance with the present invention therein would be possible. Further, there could be combinations of straight and curved wall portions, and other wall portions as desired, some of which are shown in the above mentioned commonly assigned serial numbers.

Besides providing a pinch grip in a curved wall portion, a pinch grip in accordance with the present invention could also be provided in a straight wall portion, such as straight wall portions 214 and 224 mentioned above. Thus, it would be possible to provide a container forming a polygon or other shape made up of one or more straight wall portions with a pinch grip in one (or more if desired) straight wall portions, such a rectangular container 230 depicted in FIG. 14 with pairs of straight wall portions 232 and 234 of respective lengths.

Figure 15:
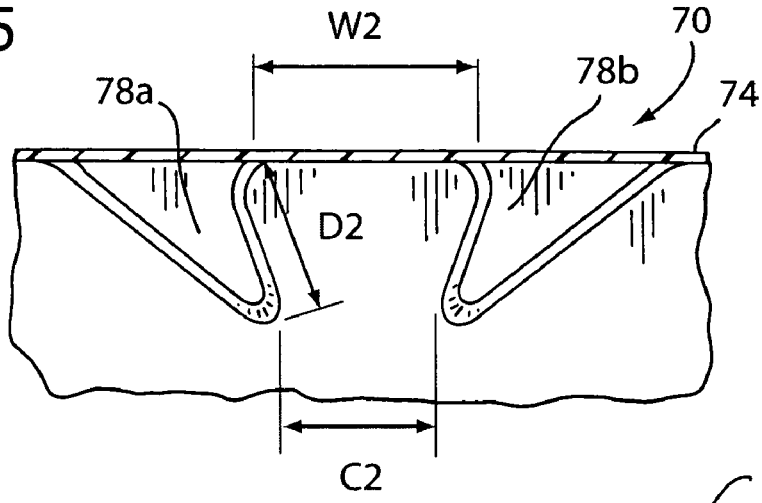
FIG. 15 is a schematic cross sectional plan view of a pinch grip, similar to that of the embodiment of FIG. 4, but with the pinch grip is located in a straight side of a container.

Examples of pinch grips which could be provided in straight wall portions are shown in FIGS. 15-18. Thus, there is shown in FIG. 15 a selected part of a container 70 including a straight wall portion 74 and a pair pinch pockets 78*a* and 78*b* provided therein. Pinch pockets 78*a* and 78*b* are substantially similar to pinch pockets 28*a* and 28*b*; and thus have the same relative distances as noted as well as the same advantages thereof, so that pinch pockets 78 will not be discussed further.

Figure 16:
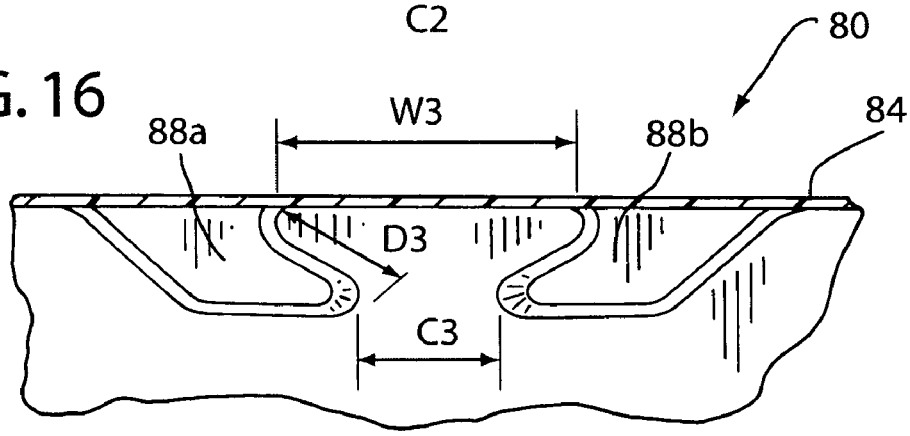
FIG. 16 is a schematic cross sectional plan view of a pinch grip, similar to that of the embodiment of FIG. 5, but with the pinch grip is located in a straight side of a container.

Similarly, depicted in FIG. 16 is a selected part of a container 80 including a straight wall portion 84 and a pair pinch pockets 88*a* and 88*b* provided therein. Pinch pockets 88*a* and 88*b* are substantially similar to pinch pockets 38*a* and 38*b*; and thus have the same relative distances as noted as well as the same advantages thereof, so that pinch pockets 88 will not be discussed further.

Figure 17:
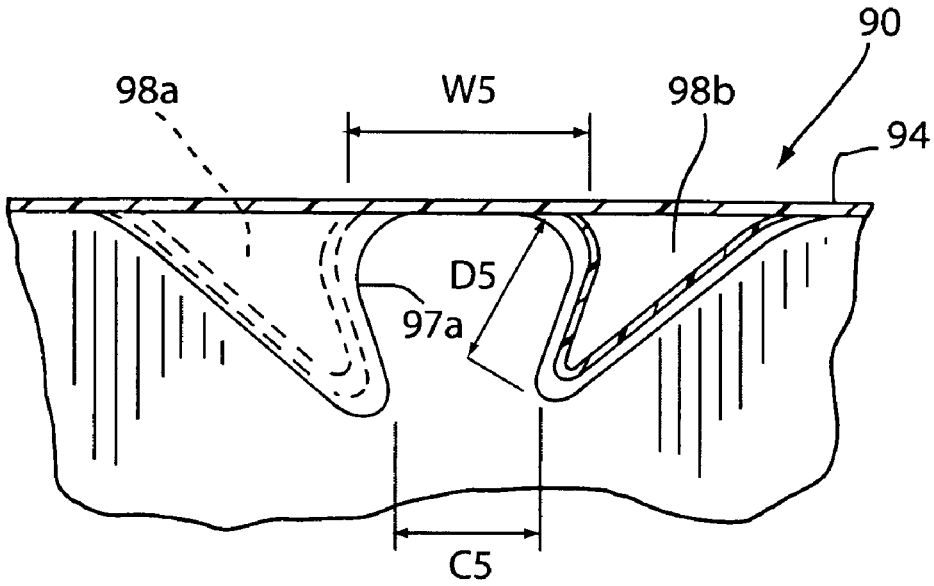
FIG. 17 is a schematic cross sectional plan view of a pinch grip, similar to that of the embodiment of FIG. 8 which is similar to the first embodiment of FIG. 4 but having a thumb receiving cavity, but with the pinch grip is located in a straight side of a container.

Also similarly, depicted in FIG. 17 is a selected part of a container 90 including a straight wall portion 94 and a pair pinch pockets 98*a* and 98*b* provided therein. Located above each pinch pocket 98 is a thumb receiving cavity, such as thumb receiving cavity 97*a* depicted. Pinch pockets 98*a* and 98*b* are substantially similar to pinch pockets 58*a* and 58*b*, which as noted above are similar to pinch pockets 28*a* and 28*b* but with a thumb receiving cavity 57 provided thereabove. Thus, pinch pockets 98*a* and 98*b* have the same relative distances as noted for pinch pockets 28 and 58, as well as the same advantages thereof, so that pinch pockets 98 will not be discussed further.

Figure 18:
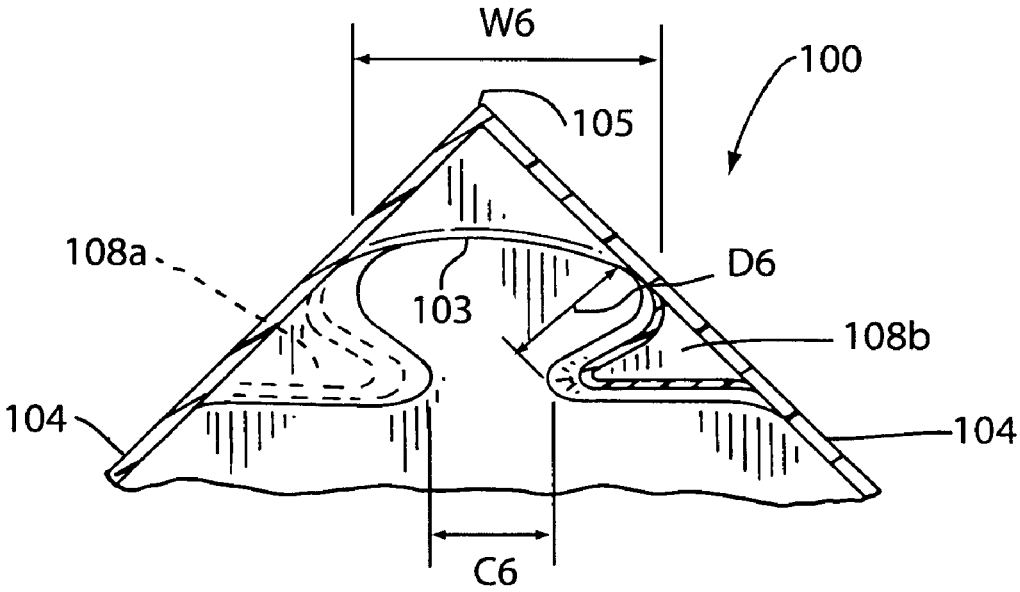
FIG. 18 is a schematic cross sectional plan view of a pinch grip, similar to that of the embodiment of FIG. 9 which is similar to the first embodiment of FIG. 5 but having a thumb receiving cavity, but with the pinch grip is located in a corner of a container.

Besides being provided in a curved or a straight wall portion of a container as described above, a pinch grip in accordance with the present invention could also be provided in a corner (intersection of two straight wall portions, or even a straight wall portion and a curved portion) such as those corners depicted in FIGS. 12-14 mentioned above. Thus, it would be possible to provide a container with a corner with a pinch grip in that corner. For example, there is shown in FIG. 18 a selected corner of a container 100 including two straight wall portions 104 and a pair pinch pockets 108*a* and 108*b* provided respectively therein. At the location between pinch pockets 108, it will be appreciated that the square corner of container 100 transitions vertically down into a curved (or straight, or other, as desired) connection 103 as shown, so that the user does not have to grip around peak 105 of the corner. Pinch pockets 108*a* and 108*b* are substantially similar to pinch pockets 68*a* and 68*b*, which as noted above are similar to pinch pockets 38*a* and 38*b* but with a thumb receiving cavity 67 provided thereabove. Thus, pinch pockets 108*a* and 108*b* have the same relative distances as noted for pinch pockets 28 and 58, as well as the same advantages thereof, so that pinch pockets 108 will not be discussed further.

Figure 19:
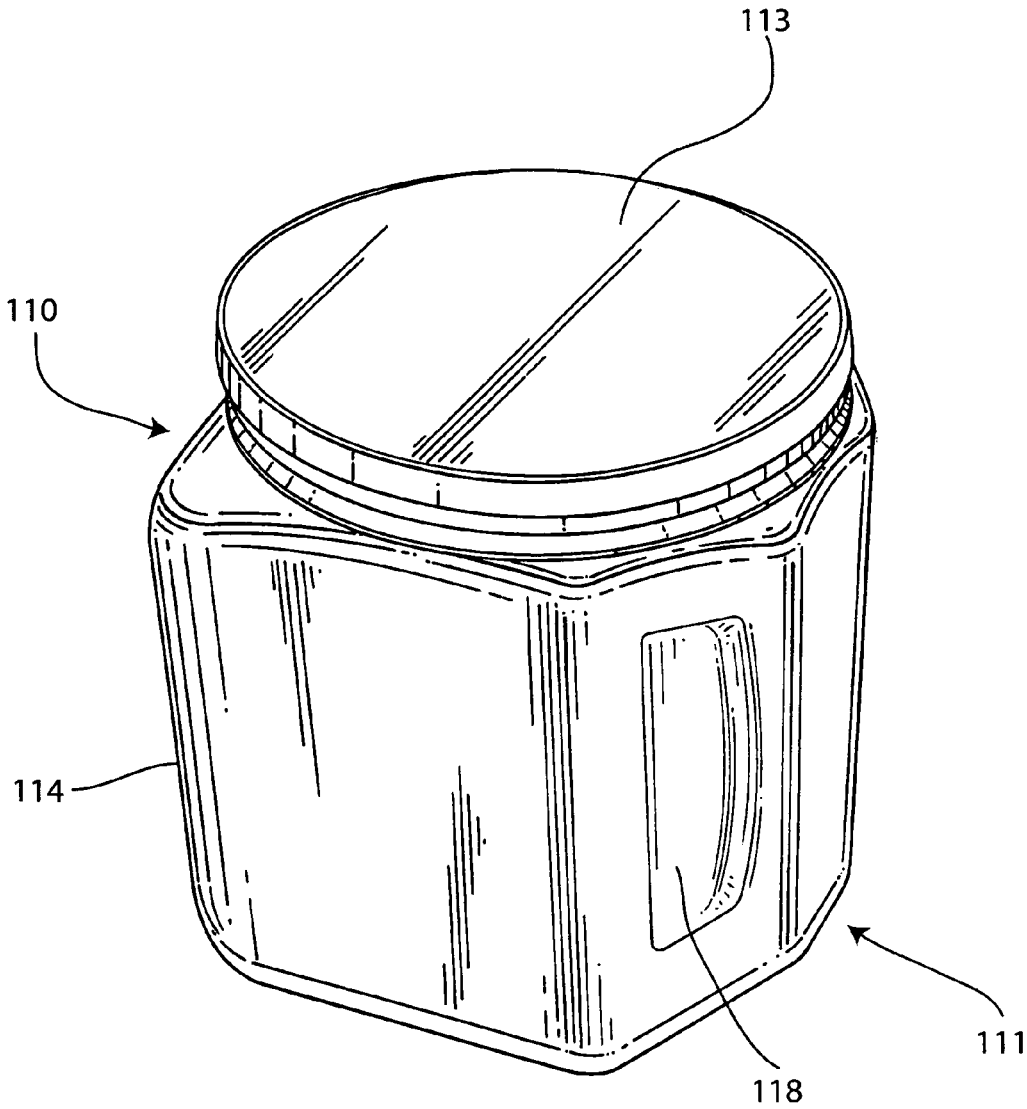
FIG. 19 is a schematic top, left side and rear perspective view of a pinch grip similar to the first embodiment of FIG. 5 located in a peaked side of a rectangular container.

Depicted in FIG. 19 is a container 110 showing another embodiment of container in which the pinch pockets described above are usable. Covering the large opening of container 110 is a removable top 113. Container 110 has a generally rectangular shape formed by surrounding wall member 114, but with one side 111 peaked from the remaining three sides as shown. Located in peaked side 111 is a pinch grip, of which only pinch pocket 118 is shown. Pinch pocket 118 and its matching pinch pocket are depicted as being substantially similar to pinch pockets 38*a* and 38*b*, but as noted other of the disclosed embodiments of pinch pockets could be used as well; and thus whatever pinch pockets were used would have the same relative distances as noted as well as the same advantages thereof.

Figure 20:
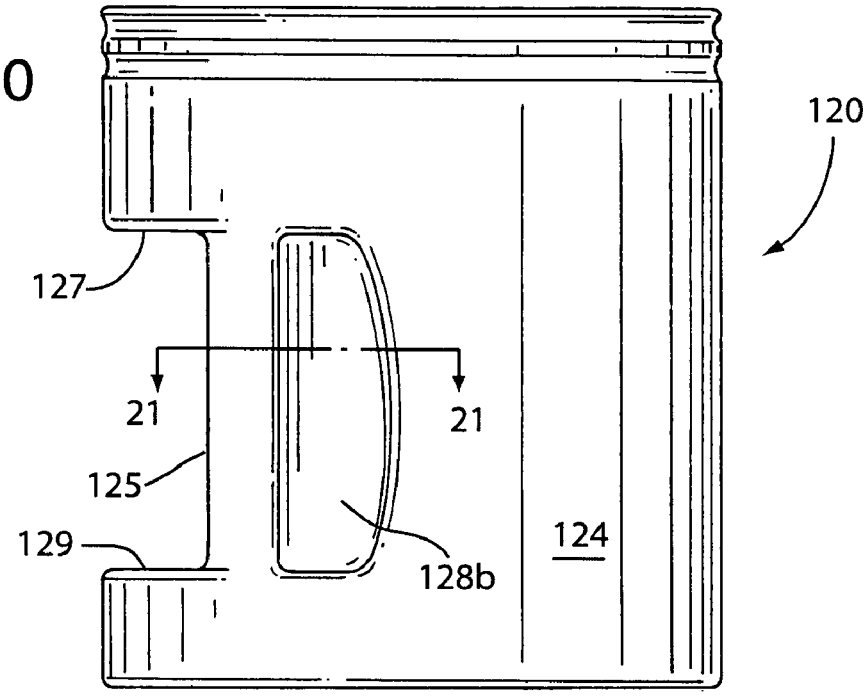
FIG. 20 is a schematic rear and left side elevation view of a coffee container, similar to that of FIG. 3, showing an embodiment of the present invention having a recess wall portion in which the pinch pockets are located.
Figure 21:
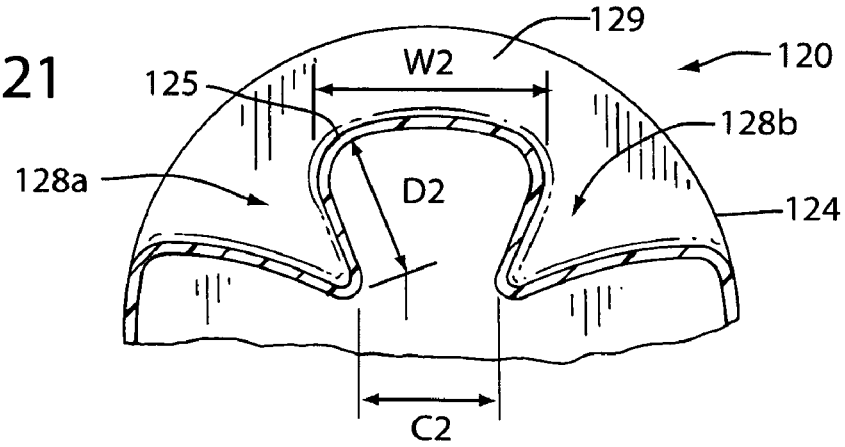
FIG. 21 is a schematic cross sectional plan view of a portion of the coffee container depicted in FIG. 20 taken along section line 21-21.

Depicted in FIGS. 20-21 is a container 120 showing another embodiment in which the pinch pockets described above are usable. In this embodiment, container 120 includes a surrounding wall 124 which has a recess wall portion 125 therein as shown. Located in recess wall portion 125 is a pair of pinch pockets 128*a* and 128*b*, which in this embodiment are of the same configuration as pinch pockets 28*a* and 28*b* of container 20 as described above. In particular, pinch pockets 128 have a same lateral opening separation W2, lateral minimum separation C2 and depth D2 as pinch pockets 28, and thus these features are so labeled and pinch pockets 128 are not described further. With the use of recess wall portion 125 with pinch pockets 128 therein, there is provided an upper support surface 127 and a lower support surface 129 respectively above and below as well as between pinch pockets 128 as shown.

The presence of recess wall portion 125 provides two mechanisms by which container 120 is easier to hold than even container 20. First, by moving pinch pockets 128 closer to the center of gravity of container 120, relative to pinch pockets 28 of container 20, there is a smaller pivot moment applied to the wrist of the user when container 120 is held using pinch pockets 128. Second, support surfaces 127 and 129 serve to provide, either singly, or preferably in combination: support against the moment as bottom support surface 129 is engaged with the bottom of the hand of the user gripping pinch pockets 128; and vertical support for the weight of container 120 as upper support surface is engaged with the top of the hand of the user. The result is thus that container 120 is even easier to hold than container 20, particularly when container 120 is full.

It will also be noted that container 120 has pinch pockets 128 located vertically differently from the previously disclosed embodiments. In particular, pinch pocket 128 are not located around the mid-point of the height of container 120, but rather downwardly therefrom. This downwardly offset location of pinch pockets 128 will make container 120 somewhat easier to hold, relative to a mid-point location of the pinch pockets, as container 120 is emptied.

Figure 22:
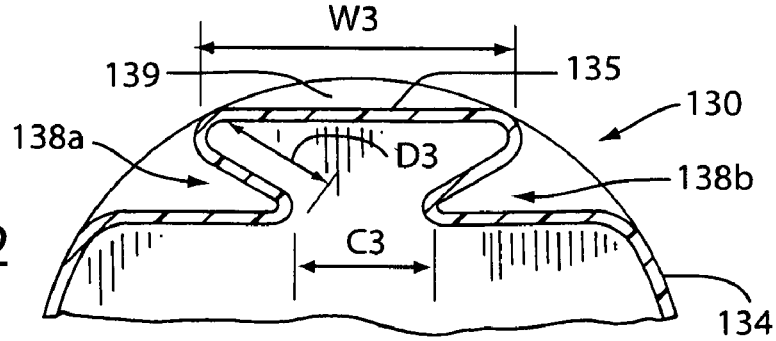
FIG. 22 is a schematic cross sectional plan view of another embodiment of a container similar to the view depicted in FIG. 21, but with differently shaped pinch pockets.

Depicted in FIG. 22 is a container 130 showing another embodiment similar to container 120 described above in which the pinch pockets described above are also usable. In this embodiment, container 130 includes a surrounding wall 134 which has a recessed wall portion 135 between a pair of pinch pockets 138*a* and 138*b* as shown. Pinch pockets 138*a* and 138*b* in this embodiment are of the same configuration as pinch pockets 38*a* and 38*b* container 30 as described above. In particular, pinch pockets 138*b* have a same lateral opening separation W3, lateral minimum separation C3 and depth D3 as pinch pockets 38 and thus these features are so labeled and pinch pockets 138 are not described further. With the use of recess wall portion 135 between pinch pockets 138, there is provided a small (especially relative to lower support surface 129 described above) lower support surface 139 and a small upper support surface (not shown, but substantially identical to small lower support surface 139) respectively adjacent recess wall portion 135. It will thus be appreciated that in the same manner as upper support surface 127 and lower support surface 129 of container 120, the upper support surface and lower support surface 139 of container 130 provide the same two advantageous mechanisms for holding container 130 as discussed above with respect to container 120.

Although the preferred embodiments of the containers have been depicted with pinch pockets which have inside walls that are generally C shaped (in longitudinal cross section), other shapes such as straight or including finger recesses would be possible.

While the present invention has been described with respect to exemplary embodiments thereof, it will be understood by those of ordinary skill in the art that variations and modifications can be effected within the scope and spirit of the invention.

I claim:

1. A plastic container for a particulate product, comprising:

a base, a surrounding wall member extending vertically upwardly from the base, and a top opening formed at a top of the vertical wall member, the top opening being large enough for a 5 inch diameter cylinder to pass therethrough in a direction parallel to its axis, a pair of pinch pockets, the surrounding wall member, except for the pinch pockets, being located radially outwardly from the top opening, said pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension ID, and the straight line distance between the innermost points of the two pinch pockets constituting a dimension C, and wherein depth D is greater than 1.25 inches and wherein the dimensions W and C together with D being greater than 1.25 inches provide a comfortable fit of the user's hand when holding the container with the user's fingers in one pocket and thumb in the other pocket.

2. A plastic container for a particulate product, said container comprising:

a base and a surrounding wall member which extends vertically upwardly from said base, a top opening which connects with the surrounding wall member, the top opening being large enough for a 5 inch diameter cylinder to pass therethrough, in a direction parallel to its axis, a pair of pinch pockets, the surrounding wall member, except for the pinch pockets, being located radially outwardly from the top opening, said pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, and wherein the distance W is less than 2.5 inches, and the depth D, in combination with the distance W, and the distance C provide a comfortable fit of the user's hand when holding the container with the user's finger or fingers in one pocket and thumb in the other pocket.

3. A plastic container for a particulate product, said container comprising:

a base and a surrounding wall member which extends vertically upwardly from said base, a pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, a top opening which connects with the surrounding wall member, said top opening being large enough to allow a 5 inch diameter cylinder to pass therethrough in a direction parallel to its axis, the surrounding wall member, except for the pinch pockets, being located radially outwardly from the top opening, and wherein the innermost points of the two pinch pockets, at a depth D, are separated from each other by distance C which is not greater than about 2 inches, and wherein the distance C, in combination with the depth D and the distance W provide a comfortable fit of a user's hand when holding the container with the user's thumb in one pocket and finger or fingers in the other pocket.

4. A plastic container for a particulate product, said container comprising:

a base and a surrounding wall member which extends vertically upwardly from the base, a top which connects with said surrounding wall member, said top including a large enough opening therein for a 5 inch diameter cylinder to pass therethrough in a direction parallel to its axis, a pair of pinch pockets, the surrounding wall member, except for the pinch pockets, being located radially outwardly from the top opening, said pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, the depth D and the distance W providing a comfortable fit for the user's hand when holding the container with the user's thumb in one pocket and the user's finger or fingers in the other pocket, and wherein the width W is less than 2.5 inches, the distance C is less than 2 inches, and the depth D is more than 1.25 inches.

5. A plastic container for a particulate product, comprising:

a base, a surrounding wall member upstanding from the base, and a top opening formed at the top of the surrounding wall member, and all parts of the surrounding wall member having at least one outward portion thereof located laterally outwardly of the top opening, the surrounding wall member having a recessed portion spaced inwardly from said outward portions to form a generally horizontal support surface, a pair of pinch pockets formed in the recessed part of the surrounding wall member, a pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, the depth D and the distance W providing a comfortable fit for the user's hand when holding the container with the user's thumb in one pocket and the user's finger or fingers in the other pocket, and the pinch pockets and the circumferential wall portion being recessed sufficiently that the top or bottom of the user's hand, as positioned with the user's thumb in one pinch pocket and the user's finger or fingers in the other pinch pocket can engage the support surface for added support of the container.

6. A plastic container as claimed in claim 5, wherein the generally horizontal support surface is an upper support surface located above the pinch pockets such that the surface of the user's hand which faces upwardly can engage the upper support surface.

7. A plastic container as claimed in claim 5, wherein the generally horizontal support surface is a lower support surface located just below the pinch pockets such that the surface of the user's hand which faces downwardly can engage the lower support surface.

8. A plastic container as claimed in claim 5, including both an upper generally horizontal support surface and a lower generally horizontal support surface, the upper support surface being located above the pinch pockets such that the surface of the user's hand which faces upwardly can engage the upper support surface, and wherein the lower support surface is located just below the pinch pockets such that the surface of the user's hand which faces downwardly can engage the lower support surface.

9. A plastic container as claimed in claim 5, wherein the generally horizontal support surface is substantially horizontal.

10. A plastic container for a particulate product, said container comprising:

a base and a surrounding wall member which extends vertically upwardly from said base, a top opening which connects with the surrounding wall member, the top opening being large enough for a 5 inch diameter cylinder to pass therethrough in a direction parallel to its axis, a pair of pinch pockets, the surrounding wall member, except for the pinch pockets, being located radially outwardly from the top opening, said pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, and wherein the distance W is less than 2.5 inches.

11. A plastic container as claimed in claim 10, wherein W is about 2.5 inches.

12. A plastic container as claimed in claim 11, wherein C is about 1.75 inches.

13. A plastic container as claimed in claim 10, wherein W is between about 2.0 and 2.5 inches.

14. A plastic container as claimed in claim 13, wherein W is about 2.5 inches.

15. A plastic container for a particulate product, said container comprising:

a base and a surrounding wall member which is upstanding from said base, a pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, a top opening which connects with the surrounding wall member, said top opening being large enough to allow a 5 inch diameter cylinder to pass therethrough in a direction parallel to its axis, the surrounding wall member, except for the pinch pockets, being located radially outwardly from the top opening, and wherein the innermost points of the two pinch pockets, at a depth D, are separated from each other by distance C which is not greater than about 2 inches.

16. A plastic container as claimed in claim 15, wherein C is about 1.75 inches.

17. A plastic container as claimed in claim 15, wherein W is between 2.0 and 2.5 inches.

18. A plastic container for a particulate product, said container comprising:

a base and a surrounding wall member which extends vertically upwardly from the base, a top which connects with said surrounding wall member, said top including a large enough opening therein for a 5 inch diameter cylinder to pass therethrough in a direction parallel to its axis, a pair of pinch pockets, the surrounding wall member, except for the pinch pockets, being located radially outwardly from the top opening, said pair of pinch pockets separated by a circumferential wall portion of the surrounding wall member, the straight line distance between the closest edges of the pinch pockets at the circumferential wall portion constituting a dimension W, the depth of the pinch pockets taken from the circumferential wall portion to the innermost point of the pinch pockets constituting the dimension D, and the straight line distance between the innermost points of the two pinch pockets constituting a dimension C, and wherein the width W is less than 2.5 inches, the distance C is less than 2 inches.

19. A plastic container as claimed in claim 18, wherein W is about 2.25 inches.

20. A plastic container as claimed in claim 19, wherein C is about 1.75 inches.

21. A plastic container as claimed in claim 2, wherein W is between about 2.0 to 2.5 inches.

22. A plastic container as claimed in claim 21, wherein each said pinch pocket has a vertical height of at least about 2.5 inches, and wherein W is about 2.25 inches.

23. A plastic container as claimed in claim 21, wherein said pinch pockets are centrally directed, and wherein depth D is not less than about 1.25 inch.

24. A plastic container as claimed in claim 23, wherein depth D is in the range of about 1.25-2.25 inches.

25. A plastic container as claimed in claim 24, wherein depth D is about 1.75 inch.

26. A plastic container as claimed in claim 2, wherein C is about 1.0 to 1.5 inches.

27. A plastic container as claimed in claim 26, wherein each said pinch pocket has a vertical length of at least about 2.5 inches, wherein W is about 2.25 inches, and wherein C is about 1.25 inches.

28. A plastic container as claimed in claim 2, wherein said surrounding wall member further includes a thumb receiving concavity above each said pinch pocket.

29. A plastic container as claimed in claim 2, wherein C is not greater than about 2.0 inches.

30. A plastic container as claimed in claim 29, wherein C is about 1.0 to 1.5 inches.

31. A plastic container as claimed in claim 30, wherein each said pinch pocket has a vertical height of at least about 2.5 inches, and wherein C is about 1.25 inches.

32. A plastic container as claimed in claim 29, wherein said pinch pockets have outside walls that are generally collinear to one another, and wherein depth D is not less than about 1.0 inch.

33. A plastic container as claimed in claim 32, wherein depth D is between about 1.25-1.75 inches.

34. A plastic container as claimed in claim 33, wherein depth D is about 1.5 inches.

35. A plastic container as claimed in claim 2, wherein a portion of said surrounding wall member including said pinch pockets is generally curved in cross section.

36. A plastic container as claimed in claim 2, wherein a portion of said surrounding wall member including said pinch pockets is generally straight in cross section.

37. A plastic container as claimed in claim 2, wherein a portion of said surrounding wall member including said pinch pockets is a corner.

38. A plastic container as claimed in claim 2, wherein a portion of said surrounding wall member including said pinch pockets is a peaked side.

39. A plastic container as claimed in claim 2, wherein only a portion of said surrounding wall member including said pinch pockets is substantially recessed radially inward relative to a remainder of said surrounding wall member.

40. A plastic container as claimed in claim 2, wherein only a portion of said surrounding wall member between said pinch pockets is recessed radially inward relative to a remainder of said surrounding wall member.

41. A plastic container as claimed in claim 2, further including a substantially horizontal support surface provided between said pinch pockets.

42. A plastic container as claimed in claim 3, wherein C is about 1.0 to 1.5 inches.

43. A plastic container as claimed in claim 42, wherein each said pinch pocket has a vertical height of at least about 2.5 inches, and wherein C is about 1.25 inches.

44. A plastic container as claimed in claim 3, wherein said pinch pockets have outside walls that are generally collinear to one another, and wherein depth D is not less than about 1.0 inch.

45. A plastic container as claimed in claim 44, wherein depth D is between about 1.25-1.75 inches.

46. A plastic container as claimed in claim 45, wherein depth D is about 1.5 inches.

47. A plastic container as claimed in claim 3, wherein said surrounding wall member further includes a thumb receiving concavity above each said pinch pocket.

* * * * *

UNITED STATES PATENT AND TRADEMARK OFFICE

CERTIFICATE OF CORRECTION

PATENT NO. : 8,313,005 B2
APPLICATION NO. : 11/498141
DATED : November 20, 2012
INVENTOR(S) : Scarola It is certified that error appears in the above-identified patent and that said Letters Patent is hereby corrected as shown below:

In the Specifications

Column 11, line 33, change “900” to -- 90° --;

Column 13, line 28, insert the word -- of -- before the word ‘container’;

In the Claims

Column 14, line 4, change “ID” to -- D --.

Signed and Sealed this
Fourteenth Day of May, 2013

Teresa Stanek Rea
*Acting Director of the United States Patent and Trademark Office*